US005746611A

United States Patent [19]

Brown et al.

[11] Patent Number: 5,746,611

[45] Date of Patent: May 5, 1998

[54] ELECTRICAL CONNECTOR SEAL CAP ASSEMBLY

[75] Inventors: Michael Dale Brown, Greensboro; Frank Louis Duncan, Madison; Ralph Talmadge Bentley, II, Belews, all of N.C.

[73] Assignee: The Whitaker Corporation, Wilmington, Del.

[21] Appl. No.: 683,602

[22] Filed: Jul. 15, 1996

[51] Int. Cl.[6] ..... H01R 13/44

[52] U.S. Cl. ..... 439/135; 439/364

[58] Field of Search ..... 439/135, 149, 439/142, 144, 364

[56] References Cited

U.S. PATENT DOCUMENTS

| | | | |
|---|---|---|---|
| 2,892,172 | 6/1959 | McGann . | |
| 3,845,234 | 10/1974 | Brenner | 174/67 |
| 4,333,698 | 6/1982 | Herbert | 339/36 |
| 4,424,407 | 1/1984 | Barbic | 174/67 |
| 4,861,282 | 8/1989 | Kobayashi et al. | 439/540 |
| 5,026,295 | 6/1991 | Fong et al. | 439/135 |
| 5,106,313 | 4/1992 | Lwee et al. | 439/135 |
| 5,440,235 | 8/1995 | Oko | 324/538 |
| 5,480,312 | 1/1996 | Watanabe et al. | 439/135 |

*Primary Examiner*—Khiem Nguyen
*Assistant Examiner*—Eugene G. Byrd

[57] ABSTRACT

An electrical connector seal cap assembly (10), includes a seal cap (20) with a seal cap gasket (28) bonded thereto, which cap is assembled to an electrical connector (30). The seal cap (20) is pressed into engagement with the electrical connector (30) by action of screw (19). As this occurs, seal cap gasket (28) is sealingly pressed against sealing interface surface (38) of electrical connector (30). Gussets (22) of seal cap (20) advantageously distribute the compressive forces generated by screw (19) in the area of the interface between seal interface (38) and seal cap gasket (28) thereby creating an effective seal against sprays or other air-borne, high velocity contaminants.

20 Claims, 2 Drawing Sheets

ELECTRICAL CONNECTOR SEAL CAP ASSEMBLY

The present invention relates to a seal cap for use with an electrical connector, wherein the seal cap comprises a seal cap gasket for sealing the interface between the seal cap and the electrical connector when the two are assembled together.

BACKGROUND OF THE INVENTION

Electrical connectors are typically installed in machinery and equipment and are often subjected to manufacturing processes including painting or other treatments whereby the electrical connector and its contacts will be fouled by the paint or other treatment. If this happens, the electrical connector will have to be discarded or cleaned before use in an electrical circuit, which is wasteful and expensive. To prevent such fouling of an electrical connector, covers have been developed to protect the electrical connector. However, prior covers have not provided a hermetic seal so that liquids, sprays, or air-borne contaminants can pass the cover and impinge on the electrical contacts within the electrical connector.

SUMMARY OF THE INVENTION

To solve the foregoing problems, the present invention provides an electrical connector with at least one electrical contact and a cover, the electrical connector and the cover comprise an assembly, the cover is fixable to the electrical connector by a holding member, the holding member is operable to apply forces to the cover for holding the cover to the electrical connector, the cover comprises a sealing member for sealing the electrical connector and protecting the electrical contact from contamination, and the electrical connector comprises a sealing interface section for sealing engagement with the sealing member.

The cover comprises a wall from which a collar extends, and at least one gusset is formed between the collar and the wall for transmitting forces from the collar to the locus of the sealing interface section. In a preferred embodiment, the cover wall comprises a plurality of such gussets.

The sealing member is formed of a compressible material, preferably, a NEOPRENE material. The holding member comprises a threaded section, and is preferably a screw-type fastener.

DETAILED DESCRIPTION OF THE INVENTION

Figure 1:
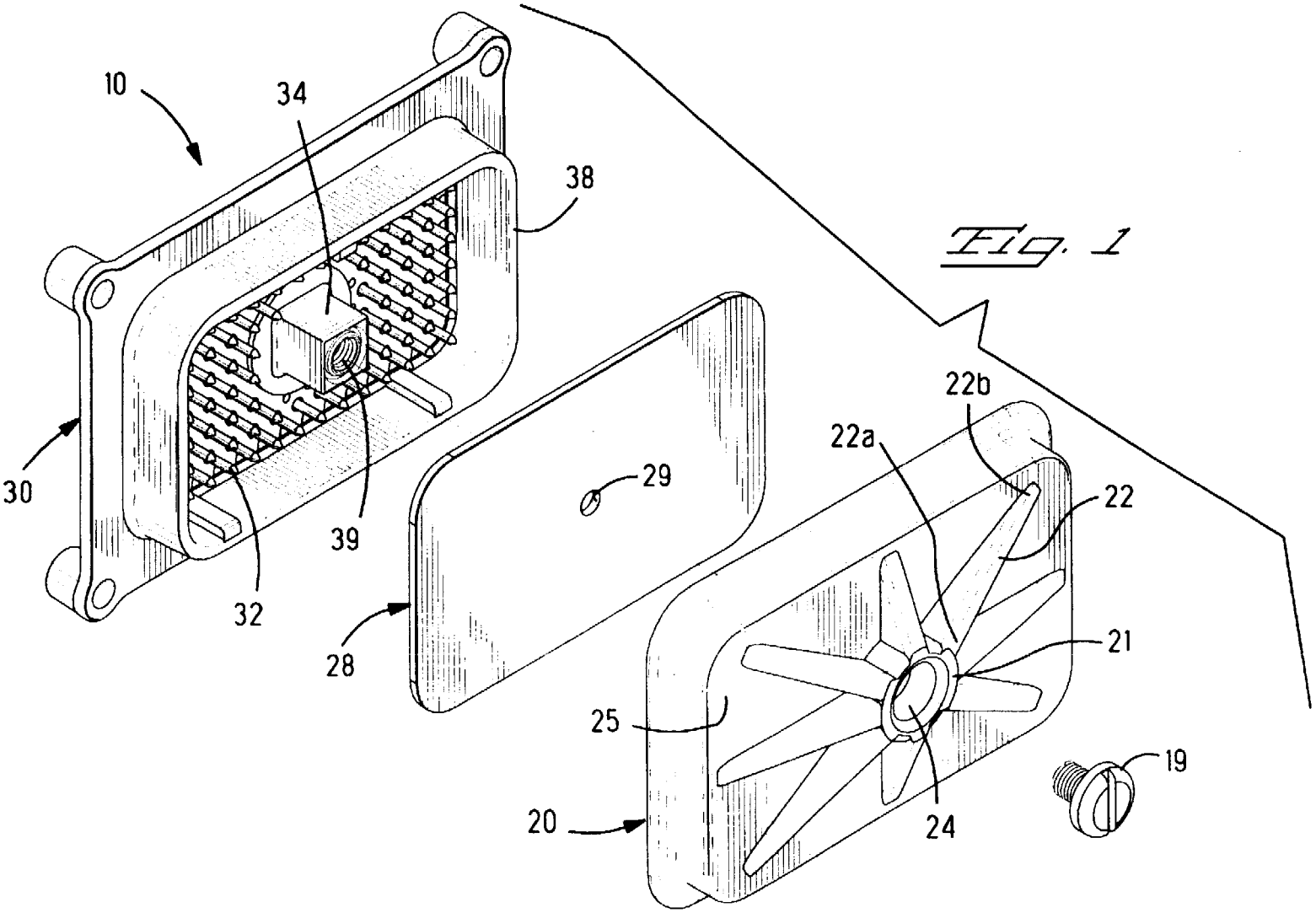
FIG. 1 shows an exploded view of the electrical connector seal cap assembly according to the present invention.
Figure 2:
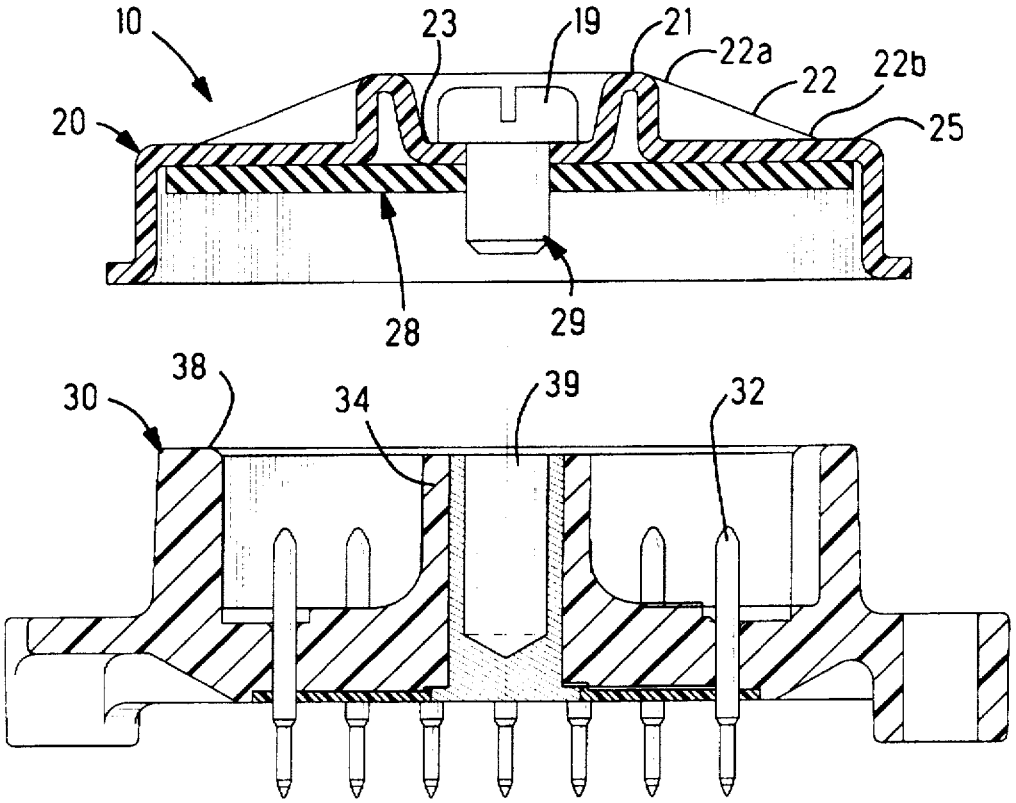
FIG. 2 shows a cross sectional view of the seal cap exploded away from the electrical connector of the FIG. 1.
Figure 3:
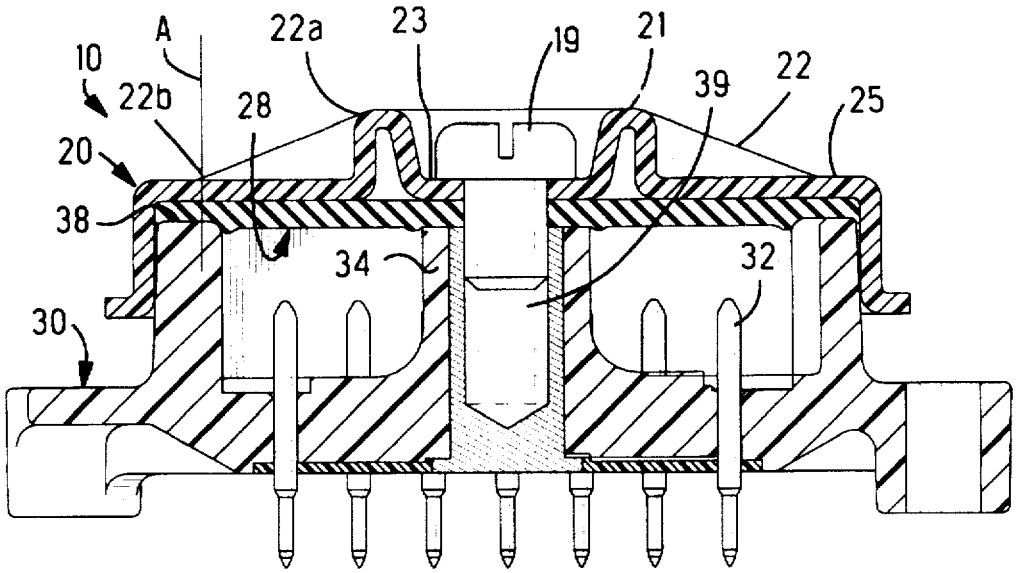
FIG. 3 shows the assembly of FIG. 1 in a cross sectional view in a fully assembled state.

Referring to FIGS. 1–3, the electrical seal cap assembly 10 according to the present invention will be described. Seal cap assembly 10 includes a seal cap 20, a seal cap gasket 28 bonded to the seal cap 20, and an electrical connector 30. Seal cap 20 includes a collar 21 with a screw receiving aperture 24 centered therein for receiving screw 19, as will be further described below. Gussets 22 extend between collar 21 and top wall 25 for reinforcing the seal cap 20 when screw 19 is activated. Each gusset comprises a head portion 22*a* which is integral with collar 21, and a foot section 22*b* which is integral with top wall 25 generally within the vicinity of the outer edges of top wall 25. As best shown in FIGS. 2 and 3, seal cap 20 includes a land 23 for engagement with screw 19. Seal cap gasket 28 is preferably formed of a suitable sealing material, and includes an engaging hole 29 which has a diameter slightly smaller than the outer diameter of the threaded portion of screw 19 thereby defining a sealing fit around the screw 19. Electrical connector 30 includes contacts 32, a screw receiving tower 34, and a seal interface surface 38 which is aligned for sealing engagement with seal cap gasket 28, as shown in FIG. 3.

Formation and assembly of the electrical seal cap assembly 10 will now be described. Seal cap gasket 28 is first bonded to seal cap 20 so that the seal cap gasket 28 is flat and wrinkle free after bonding. The seal cap 20 is preferably plastic and is formed from a vacuum forming process which forms the seal cap including collar 21 and gussets 22. The seal cap gasket 28 is formed of an adhesive backed NEOPRENE closed cell foam preferably of a range of 35 to 45 durometer. The seal cap material is preferably a non-conductive ABS plastic material suitable for use with the vacuum forming process. The engaging hole 29 of seal cap gasket 28 is preferably sized to have no clearance around the perimeter of the screw 19, which screw is preferably formed of a NYLON material.

After the seal cap gasket 28 has been bonded to seal cap 20, screw 19 is inserted into screw receiving aperture 24 and through engaging hole 29. The edges of aperture 24 comprise detent fingers (not shown in the drawing) which engage the threaded portion of screw 19 thereby loosely mounting screw 19 to the cap 20 as shown in FIG. 2. Next, seal cap 20 including seal cap gasket 28 is aligned with electrical connector 30 so that sealing interface surface 38 is in pressing engagement with seal cap gasket 28, as best shown in FIG. 3. At this point, fastener 19 is made to threadably engage threaded tower 34 so that the seal cover 20 is pressingly mounted to electrical connector 30. In an important aspect of the present invention, when screw 19 is fastened into threaded hole 39, the head of screw 19 presses on land 23 so that the compressive forces thereby generated are transmitted to collar 21, and the forces are thereby transmitted to respective gusset heads 22*a*. The forces are then transmitted through gussets 22 to respective gusset feet 22*a*, especially in the locus of the outer edge of seal cap gaskets 28 which are disposed adjacent to seal interface surfaces 38. As shown in FIG. 3, the forces are advantageously transmitted to the area of the interface of seal cap gasket 28 with seal interface surface 38, as shown by plane A, thereby advantageously compressing the gasket 28 against seal interface surface 38 and defining a good seal. The gussets 22, therefore, are operative to transmit the forces from screw 19 to the most advantageous location on the seal cap 20, thereby increasing the compressive force in the area where the cap is doing the most sealing, i.e. adjacent to seal interface 38. Moreover, cover 20 protects seal interface surface 38 from the deposition of contaminant matter and mechanical damage, e.g. scoring. Such protection is important because the surface 38 is used to sealingly engage a sealing ring of a further electrical connector (not shown in the drawings).

As shown in FIG. 3, the completed assembly is a hermetically sealed arrangement whereby pressurized liquids or sprays will be prevented from entering into electrical connector 30, and the assembly 10 thereby avoids, for example, any paint or coatings from impinging on the electrical contacts 32. In this regard, the present invention defines a true hermetic seal because it is capable of withstanding static pressure loads, for example, 1.5 psi of static fluid pressure.

When the assembly is in the fully assembled state, there is preferably no gap between the screw receiving tower 34 and the seal cap gasket 28. The absence of such a gap allows the forces from screw 19 to be distributed to seal interface surfaces 38, and the seal 28 to engage the top surface of screw receiving tower 34, thereby creating a hermetic seal therearound.

Although a sealing member 28 is disclosed in the preferred embodiment, it is contemplated that, for the purpose of making a dust cover, the cover 20 can be formed with a sealing lip or ledge whereby the need for a separate sealing member is obviated. Thus, while a preferred embodiment of the present invention has been disclosed, it is to be understood that the invention is not to be strictly limited to such embodiment but maybe otherwise variously embodied and practiced within the scope of the appended claims Accordingly, what is claimed is:

1. An electrical connector with a cover, the electrical connector and the cover comprise an assembly, the assembly comprising:

the cover is fixable to the electrical connector by a fastener, the fastener pressing on the cover so that the fastener is operable to apply forces to the cover for holding the cover to the electrical connector;

the cover comprises a sealing member for hermetically sealing the electrical connector; and the electrical connector comprises a sealing interface section for sealing contact with the sealing member.

2. The assembly of claim 1, wherein the cover comprises a wall from which a projection extends, and a gusset formed between the projection and the wall for transmitting forces from the projection to the locus of the sealing interface section.

3. The assembly of claim 1, wherein the cover comprises a wall from which a collar extends, and a gusset formed between the collar and the wall for transmitting forces from the collar to the locus of the sealing interface section.

4. The assembly of claim 2, wherein the cover comprises a plurality of the gussets.

5. The assembly of claim 4, wherein the gussets radiate outwardly from the projection generally toward the sealing interface.

6. The assembly of claim 1, wherein the sealing member is formed of a compressible material.

7. The assembly of claim 1, wherein the sealing member and the cover are made of different materials.

8. The assembly of claim 1, wherein the fastener comprises a threaded section for cooperation with a threaded section of the electrical connector.

9. An electrical connector with at least one electrical contact and a cover, the electrical connector and the cover comprise an assembly, the assembly comprising:

the cover is fixable to the electrical connector by a holding member, the holding member pressing on the cover so that the holding member is operable to apply forces to the cover for holding the cover to the electrical connector;

the cover comprises a sealing member for hermetically sealing the electrical connector and protecting the electrical contact from contamination;

and the electrical connector comprises a sealing interface section for sealing engagement with the sealing member.

10. The assembly of claim 9, wherein the cover comprises a wall from which a projection extends, and a gusset formed between the projection and the wall for transmitting forces from the projection to the locus of the sealing interface section.

11. The assembly of claim 9, wherein the cover comprises a wall from which a collar extends, and a gusset formed between the collar and the wall for transmitting forces from the collar to the locus of the sealing interface section.

12. The assembly of claim 10, wherein the cover wall comprises a plurality of the gussets.

13. The assembly of claim 12, wherein the gussets generally radiate outwardly from the projection toward the sealing interface.

14. The assembly of claim 9, wherein the sealing member is formed of a NEOPRENE material.

15. The assembly of claim 9, wherein the sealing member and the cover are made of different materials.

16. The assembly of claim 9, wherein the holding member comprises a threaded section.

17. An electrical connector assembly comprising an electrical connector and a cover for sealing one face of the electrical connector and for protecting the electrical connector from contamination:

the electrical connector having otherwise exposed electrical contacts surrounding a tower and surrounded by a peripheral seal interface surface;

the cover comprising a vacuum formed member having a flat upper wall with gussets extending radially from a central aperture toward spaced edges of the cover with a seal secured to an inner surface of the cover upper wall, the cover comprising means for covering the otherwise exposed electrical contacts and the peripheral seal surface when attached to the electrical connector;

a fastener positioned in the central cover aperture and comprising means for attaching the cover to the electrical connector tower with the gussets comprising means for transmitting forces applied through the fastener to the edges of the cover to compress the seal against the electrical connector peripheral seal interface surface whereby a hermetic seal is maintained between the cover and the electrical connector.

18. The assembly of claim 17 wherein the seal includes a central opening through which a screw threaded fastener extends, the seal engaging the tower when the cover is fastened to the electrical connector to maintain a hermetic seal surrounding the fastener.

19. The assembly of claim 17 wherein the cover includes a cylindrical collar surrounding the central aperture and gussets radiate from the collar with the height of the gussets decreasing from the collar toward the edge of the cover.

20. The assembly of claim 17 wherein the electrical connector comprises a connector matable with a mating electrical connector with the cover hermetically sealing a mating face of the electrical connector in an unmated state before the electrical connector is mated to the mating electrical connector, and the cover being removable to permit the mating the electrical connector with the mating electrical connector so that the cover protects an otherwise exposed mating face on the electrical connector.

* * * * *